US006409108B1

(12) United States Patent
Wark et al.

(10) Patent No.: US 6,409,108 B1
(45) Date of Patent: Jun. 25, 2002

(54) DAMAGE-RESISTANT DEFLECTOR VANE

(75) Inventors: Rickey E. Wark, The Woodlands, TX (US); John Anthony Nardi, Clinton Twp., MI (US)

(73) Assignee: Sure Alloy Steel Corporation

( * ) Notice: Subject to any disclaimer, the term of this patent is extended or adjusted under 35 U.S.C. 154(b) by 0 days.

(21) Appl. No.: 09/747,853

(22) Filed: Dec. 22, 2000

(51) Int. Cl.[7] ..... B02C 15/00
(52) U.S. Cl. ..... 241/119
(58) Field of Search ..... 241/117–121, 288, 241/289, 290

(56) References Cited

U.S. PATENT DOCUMENTS

| | | | |
|---|---|---|---|
| 3,040,888 | A | 6/1962 | Hosokawa et al. |
| 4,504,018 | A | 3/1985 | Diggins |
| 4,598,872 | A | 7/1986 | Henne et al. |
| 4,638,953 | A | 1/1987 | Taylor |
| 4,750,677 | A | 6/1988 | Taylor |
| 4,907,751 | A | 3/1990 | Wark et al. |
| 5,090,631 | A | 2/1992 | Wark |
| 5,186,404 | A | 2/1993 | Wark |
| 5,251,831 | A | 10/1993 | Yoshida et al. |
| 5,381,968 | A | 1/1995 | Lohnherr et al. |
| 5,533,629 | A | 7/1996 | Ito et al. |
| 5,957,300 | A | 9/1999 | Nardi et al. |

FOREIGN PATENT DOCUMENTS

| | | |
|---|---|---|
| DE | 264 156 | 9/1987 |

*Primary Examiner*—Mark Rosenbaum
(74) *Attorney, Agent, or Firm*—Young & Basile

(57) ABSTRACT

A deflectable vane member for a coal mill pulverizer throat. The vane is yieldingly mounted in the throat with a spring support member whose force is designed to hold the vane rigidly in place during normal operations, and to yield when the vane is struck by large debris with sufficient force. The spring support member causes the vane to spring back into its operative position after it has yielded to the debris.

6 Claims, 5 Drawing Sheets

DAMAGE-RESISTANT DEFLECTOR VANE

FIELD OF THE INVENTION

The present invention is in the field of deflector vanes used in the "throat" portions of coal mill pulverizers.

BACKGROUND OF THE INVENTION

Coal mill pulverizers, especially those of the bowl mill roller type, are typically provided with a pulverizer "throat" comprising an annular air passage surrounding the pulverizer and directing an upward flow of air around the pulverizer to entrain freshly-pulverized coal particles upwardly to a classifier device. The pulverizer throat is typically provided with a plurality of angled deflector vanes which impart a spiral direction to the air flow to better assist the classifying function. Pulverizer throats come in both stationary and rotating types.

The deflector vanes themselves are often fixed in place, although adjustable vanes have been developed which allow the air passages between the vanes to be adjusted as to flow area and angular orientation.

The coal originally fed into the pulverizer is often preclassified using known sortation machinery to eliminate debris such as rock and scrap or "tramp" iron. Occasionally, however, heavy debris such as tramp iron is fed into the pulverizer and collides with the deflector vanes in the throat. If the debris is big enough, the vanes can be damaged and even broken off.

SUMMARY OF THE INVENTION

The present invention is a spring-loaded, deflectable deflector vane which, under suitably forceful impact by large pieces of debris, momentarily deflects to absorb the shock and then springs back into position.

In a first embodiment a vane is pivotally mounted in the pulverizer throat on an axis permitting it to rotate downwardly and outwardly. A torsion spring has one end secured to the lower side of the deflector vane, and the other end secured to a fixed location such as the inner ring or "race" of the pulverizer throat. When a large piece of debris strikes the upper surface of the vane, the vane is momentarily forced downwardly and outwardly against the force of the spring, letting the impacting piece pass to the lower mill reject (pyrite) area, and thereby producing a resistive force which returns the vane to its normal position after the collision.

In a second embodiment the vane is supported in the pulverizer throat on the axis of a horizontal tubular coil spring which has an outer end connected to the vane and an inner end secured to the pulverizer throat or other fixed structure in close association with the vane. The spring is sufficiently rigid to function as a vane support during normal vane operation. Debris striking the vane causes it to deflect downwardly and outwardly as the axis of the normally rigid tubular vane support is bent.

Although torsion and coil springs are preferred, other types of spring such as leaf springs and spring equivalents could be used in the invention to provide a normally rigid vane support capable of yielding to sharp blows and then forcing the vane back to its usual position.

The vane is preferably mounted to a radially inner portion of the throat to deflect downwardly and outwardly. Whether the deflection can be described as more downward or more outward will depend on the shape and angular orientation of the vane in its rest position. It will be understood that "outward" is to be understood relative to the portion of the throat on which the vane is mounted.

These and other features and advantages of the invention will become apparent on a further reading of the specification, in light of the accompanying drawings.

DETAILED DESCRIPTION OF THE ILLUSTRATED EMBODIMENT

Figure 1:
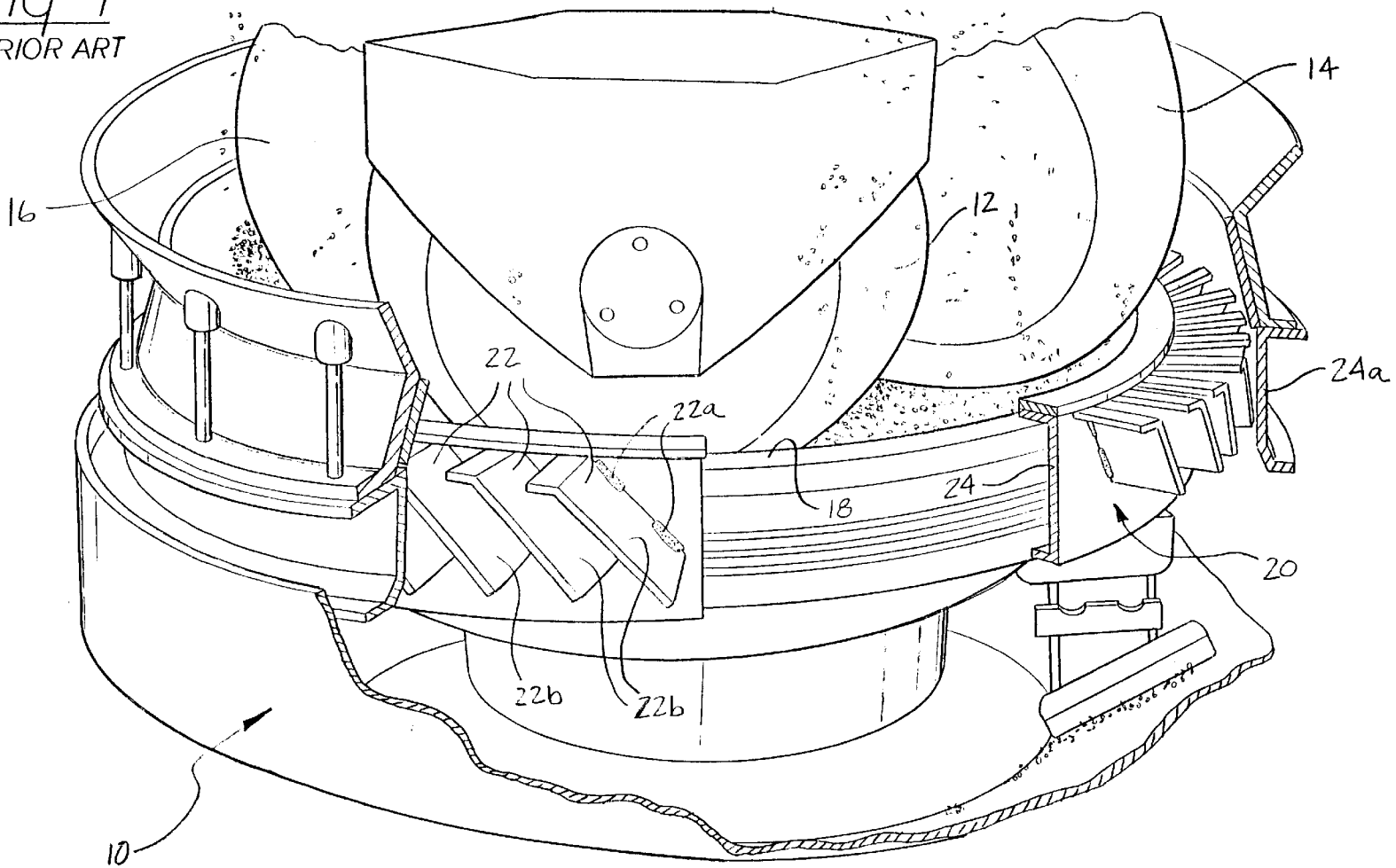
FIG-1 PRIOR ART
FIG. 1 is a partially cut-away, perspective view of a typical pulverizer throat vane arrangement according to the prior art.

Referring to FIG. 1, a typical bowl mill type pulverizer 10 comprises grinding wheels 12, 14, and 16, operating to crush coal in a bowl 18. Surrounding the bowl 18 and rotatable therewith is a rotating vane assembly 20 which includes an essentially circular arrangement of uniformly spaced, angled steel vanes 22 through which air is caused to flow upwardly around the periphery of the grinding bowl 18 for the purpose of carrying coal fines to a classification area above the pulverizer. Vanes 22 are welded to a steel inner ring or race 24 which is mounted for rotation around bowl 18. Larger particles of ground coal and occasional pieces of debris may pass downwardly through the vanes 22 into the lower section of the bowl mill 10, to be handled in known manner.

While FIG. 1 illustrates a rotating vane assembly 20, it is also known to provide vanes such as 22 in fixed, non-rotating vane assemblies in a manner well known to those skilled in the art. The overall construction and operation of bowl mill type pulverizers with both rotating and stationary throats is well known.

It is a common practice to refer to the annular space bounded by the inner and outer races 24, 24*a* of the vane assembly 20 as the pulverizer "throat", and this term will be used hereafter to generally denote the region through which air passes an array of vanes to entrain coal fines spilling over from the pulverizer bowl. It should be understood that although annular, ring-like throats are typical, other shapes may occur.

Vanes 22 are fixed in place by welds 22*a* on inner race 24; they may also include adjustable airflow control devices on lower surfaces which can be adjusted relative to the lower surface of their respective vanes to extend in greater or lesser degrees into the upward flow of air between the vanes. The construction of such airflow control devices are known to those skilled in the art and the operation of one type is described in detail in U.S. Pat. No. 5,090,631, for example.

Figure 2:
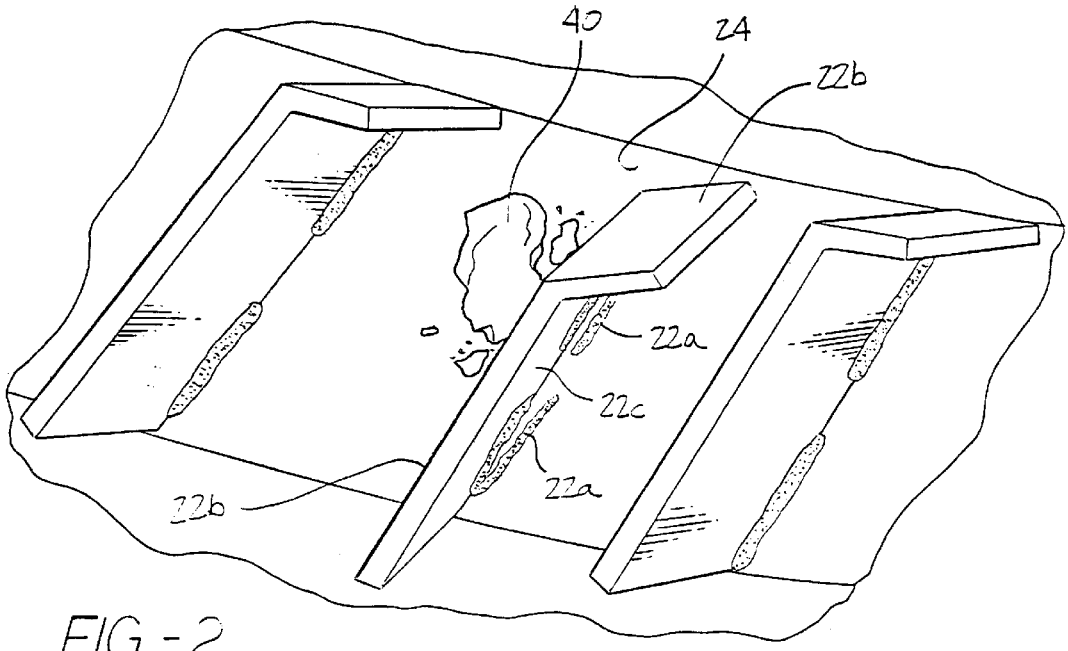
FIG-2 PRIOR ART
FIG. 2 illustrates one of the FIG. 1 vanes being broken off by impact with a large piece of debris cascading over the bowl of the pulverizer.

Referring next to FIG. 2, it is not uncommon for large pieces of debris to be delivered into the pulverizer, where they fall or are thrown against the upper surfaces 22*b* of vanes 22 in the pulverizer throat. In FIG. 2 a large piece of debris labeled 40 is illustrated as impacting and breaking one of the welded steel vanes 22 off the inner race 24. This type of damage is difficult to repair, since an entire vane assembly falling off can cause damage to the lower pyrite area and results in pulverizer downtime while the vane is being replaced or repaired. Damage or destruction of a vane also affects the efficiency of the classifying function near the upper end of the classifier, as will be understood by those skilled in the art.

Figure 3:
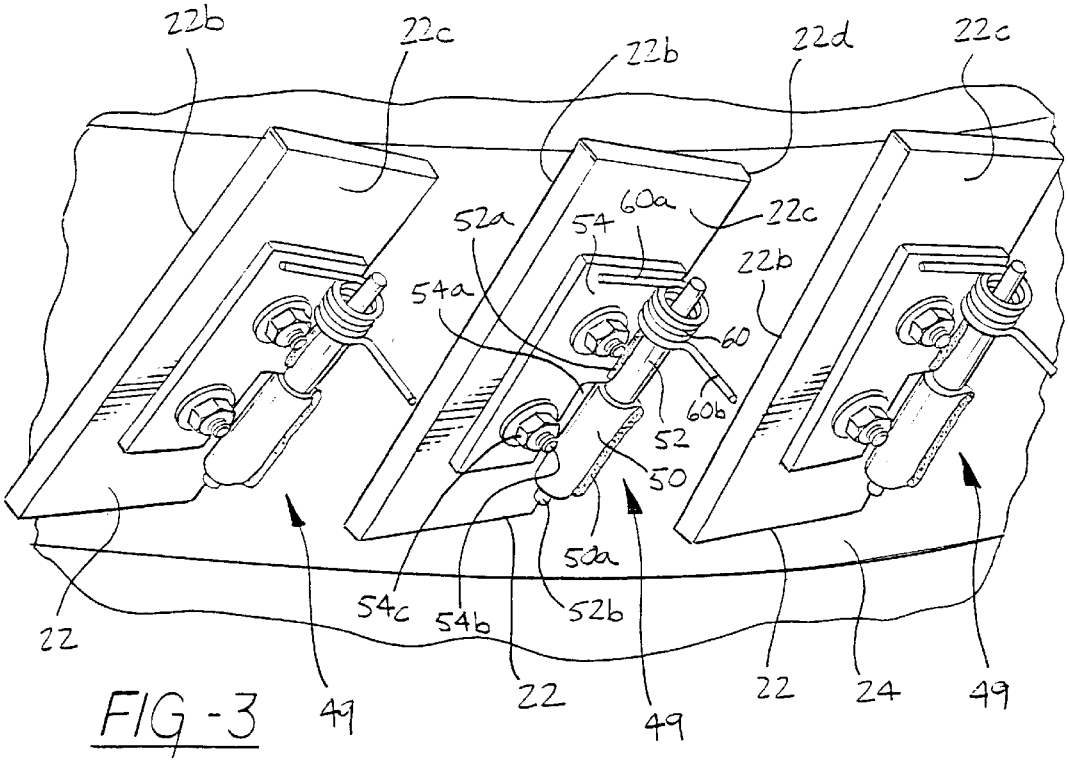
FIG. 3 is a rear, perspective view of a deflectable vane according to the present invention, using a pivoting torsion spring support.

Referring now to FIG. 3, the plurality of vanes 22 are shown modified according to the present invention. While the vanes 22 themselves are standard, having upper surfaces 22*b,* lower surfaces 22*c,* and coming in various shapes and sizes, the manner in which vanes 22 are mounted in the pulverizer throat allows them to deflect to allow heavy debris to pass without becoming damaged or broken off.

The underside of each vane 22 is provided with a spring return mount 49 which in the illustrated embodiment is secured to inner race 24. Each spring return mount includes pivot bushing or mount 50 secured to inner race 24 with a weld 50*a*. The illustrated pivot mounts 50 comprise hollow tubes rotatably supporting steel pivot pins 52 which have upper ends extending from pivot mount 50 and secured to the underside of the associated plate 54, for example as shown at weld 52*a*. More specifically in the illustrated embodiment, each pivot pin 52 is welded at its upper or external end to a spacer plate 54 fastened to the underside 22*c* of the vane. Spacer plate 54 functions as an adapter to allow the flat-bottomed vane 22 in the illustrated example to be conveniently welded to the pivot pin, in particular where the invention is applied as an add-on modification to an existing vane wheel and vane arrangement using standard vanes. It should be noted in FIG. 3 that plate 54 has a cut-out portion 54*a* at its lower end to make room for the larger-diameter pivot bushing 50.

Spacer plate 54 can further function as a removable mounting platform for a standard vane such as that shown at 22. This allows for the easy replacement of vane 22 should the vane itself become damaged despite the assistance of the invention, or should the vanes become worn in the ordinary course of use. The removable mounting platform of plate 54 allows the quick switch-out of different types of vanes on the same spring return mount, which is more permanently secured to inner race 24. In the illustrated embodiment, vane 22 is attached to mounting plate 54 with simple bolt and nut structure 54*b,* 54*c*.

It will be apparent to those skilled in the art that while the foregoing specific methods of attaching various portions of the spring return mount 49 to the inner race 24 and to vane 22 are preferred, it will be understood that other securing methods and techniques can be used which are known to those skilled in the art. For example, rather than welds 50*a* and 52*a,* various mechanical fasteners could be used.

It will generally be preferred to mount vane 22 on spring return mount 49 with the vane's inside edge 22*d* immediately adjacent or abutting the wall of race 24. This serves to protect spring return mechanism 49 not only from larger pieces of debris, but also from the abrasive effect of oversized coal fines flowing over the lip of the pulverizer into the throat.

Spring return mount 49 includes a spring 60, in the illustrated embodiment a coil spring having a vane end 60*a* and a race end 60*b* respectively held against or secured to vane 22 and race 24. Spring 60 is preferably at least axially secured on pivot pin 52, for example with a weld, stop, or internal collar on pin 52 which prevents spring 60 from sliding off the upper end of the pin.

Figure 3A:
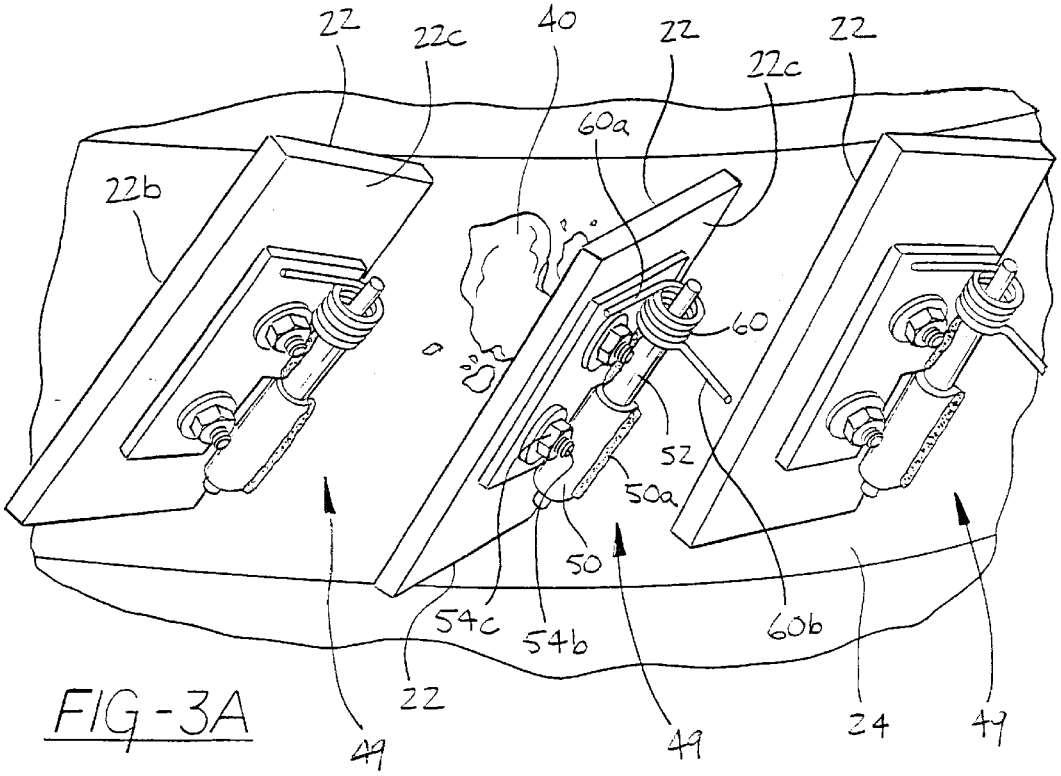
FIG. 3A illustrates the vane of FIG. 3 deflecting under impact from debris.

Referring next to FIG. 3A, when a large piece of debris such as 40 strikes the upper surface of one of the vanes 22 provided with spring return mount 49, the vane with its attached pivot pin 52 rotates downwardly and outwardly along the axis of bushing 50, yielding to the impact force and safely allowing debris to pass to the pyrite section of the mill for normal ejection and thereby preserving the vane. Since the vane is mounted in a pivoting manner to race 24, no damage is suffered by the vane mount. Instead, as vane 22 rotates downwardly and outwardly (relative to the inner race 24) on the pivot axis defined by mount 49, upper end 60*a* of the spring is forced inwardly against the spring winding force while lower end 60*b* remains fast against race 24. This means that the force of the blow from debris 40 is progressively absorbed by and stored in spring 60, until the debris has bounced off, at which point spring 60 forces upper leg 60*a* and therefore vane 22 back up into the normal vane operating position shown in FIG. 3.

It can be seen from the foregoing that vanes provided with the spring return mechanism according to the invention are virtually impervious to heavy blows, greatly extending their useful life in the pulverizer throat. It can also be seen that the angled pivot axis defined by mount 49, aligned along the inner edge of the vane and parallel to the race, provides a unique downward and outward deflecting movement believed to have been unknown in the pulverizer throat art until now.

Figure 4:
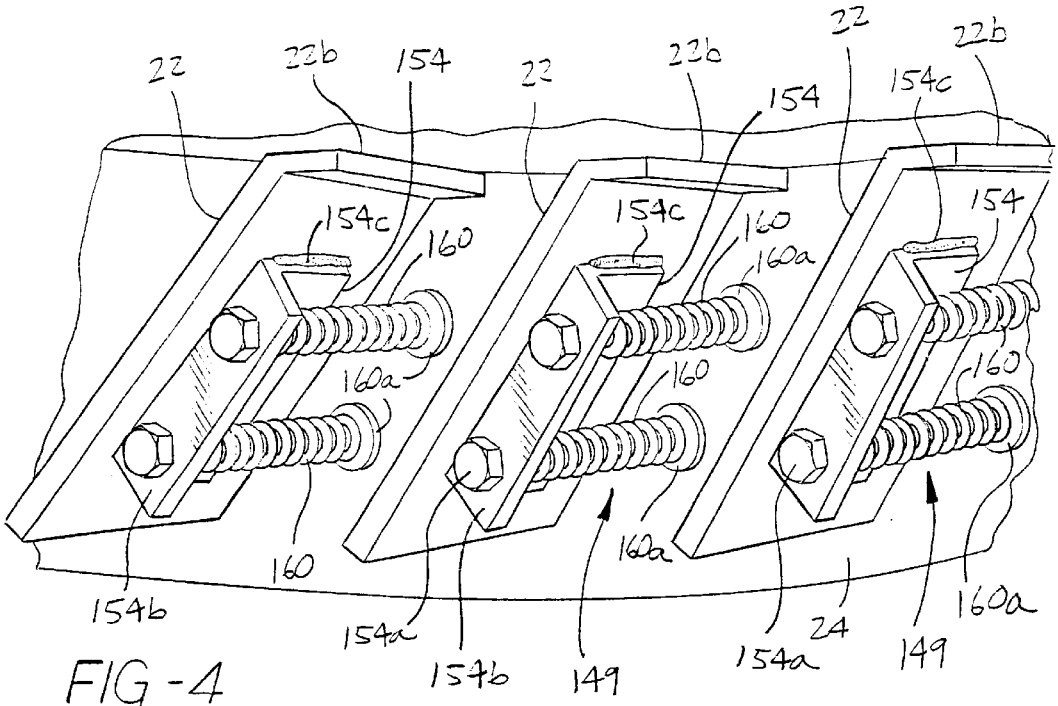
FIG. 4 is a rear perspective view of an alternate embodiment of the invention, using a tubular coil spring as the spring support.
Figure 4B:
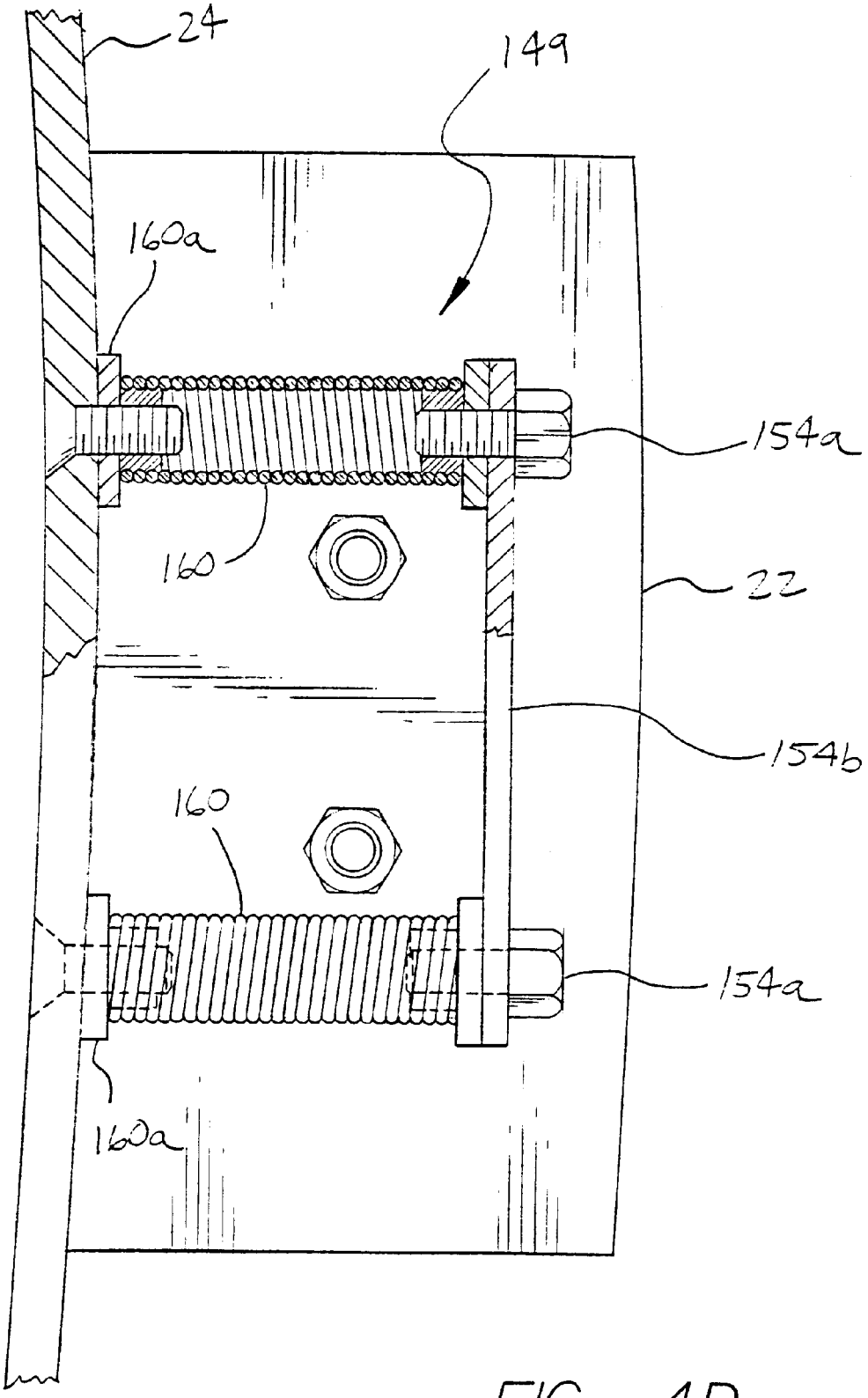
FIG. 4B is a plan view, partially sectioned, of a vane and mount from FIG. 4A.
Figure 4A:
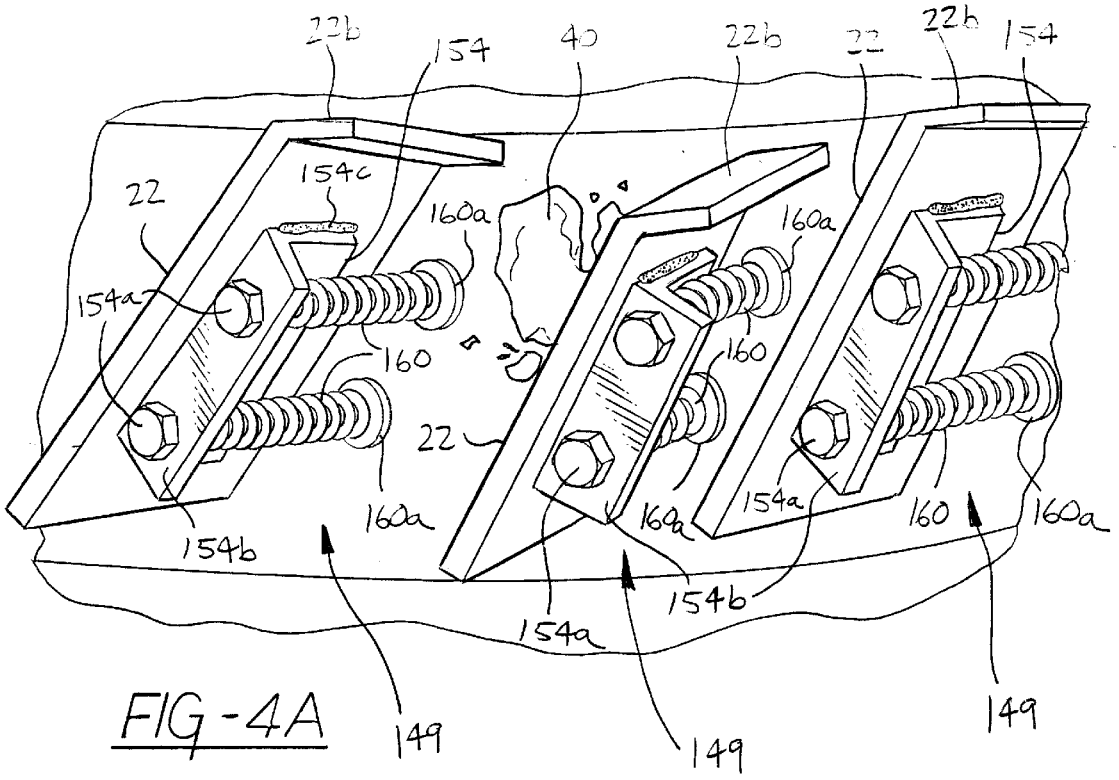
FIG. 4A illustrates the vane of FIG. 3 deflecting under impact from debris.

Referring next to FIGS. 4, 4A, and 4B, an alternate spring return mechanism 149 is illustrated comprising horizontally arranged tubular spring elements 160 comprising stiff, tightly coiled springs with enough rigidity to provide horizontal supports for the underside of vanes 22 under normal operating conditions, but to yield in a manner similar to the spring return mechanism 49 in FIG. 3 when the vanes are struck by debris, as best shown in FIG. 4A. These alternate spring return mechanisms 149 further include an angled spacer plate 154 welded or removably fastened to the underside of vanes 22 to provide a mounting platform for the ends of horizontally arrayed tubular springs 160. In the illustrated embodiment of FIG. 4, springs 160 are secured to the perpendicular portion 154*b* of plate 154 with bushings 160*a* secured to the ends of the springs and in turn fastened to plate portion 154*b* with through-bolts 154*a* extending through the plate and bushings and at least partway into the springs, secured therein in a suitable fashion, for example with a nut. Other methods of securing the spring ends to the vane are of course possible and within the abilities of those of ordinary skill in the art.

Comparison of the spring return mounts 49,149 in FIGS. 3 and 4 shows that mount 149 is better suited for vanes with an overhanging, differently-angled upper leg due to the different range of motion through which the horizontal springs allow the vane to yield. The fixed pivot axis of mounts 49 in FIG. 3 immediately adjacent and tangential to race 24 requires vanes shaped such that no protruding portion or edge geometry will interfere with the desired range of pivot motion by colliding with race 24. The flat, rectangular vanes illustrated in FIG. 3 are one possible and preferred shape.

In FIG. 4, like in FIG. 3, the spring return mechanism is shown secured to inner race 24 of the pulverizer throat. It will again be emphasized that the invention can be practiced by securing portions of the spring return mechanism to the inner race, the outer race, or any other portion of the pulverizer in a location suitable to provide a convenient mount for a vane in the throat. In the illustrated embodiment, the race-side ends of springs 160 are secured to annular bushings 160*a,* for example by welding the end of the spring to the bushing. Bushing 160*a* can in turn be welded to the inner race 24, or if possessing an aperture therethrough coaxial with the spring, can be secured to the inner race mechanically, for example with a bolt extending through the race wall into the aperture in the bushing. A preferred arrangement for securing the springs to plate 154 and inner race 24 is shown in FIG. 4B.

Figure 5:
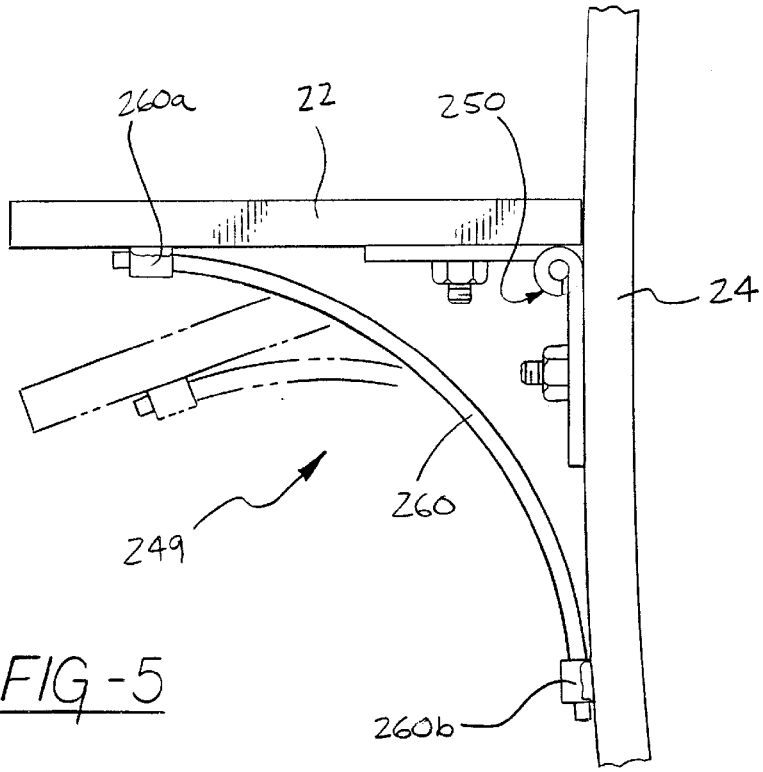
FIG. 5 is a plan view of another alternate spring support for the vane of the present invention, illustrating the use of a leaf spring.

Referring next to FIG. 5, a vane 22 is illustrated as being pivotally mounted on race 24 in a manner similar to that shown in FIG. 3, but with a leaf spring element 260 secured at each end 260*a,* 260*b* to vane 22 and race 24, respectively. In the embodiment of FIG. 5, the spring element 260 is mounted separately from the pivot attachment 250 of vane 22 to the race 24. Illustrated pivot mount 250 can be a hinge-type of a kind commonly available, for example bolted to vane 22 and race 24.

It will accordingly be understood by those skilled in the art that while we have disclosed several embodiments of the invention, there will be many different ways to carry out the invention according to its principles without departing from the scope of the invention as defined in the appended claims. For example, the exact type of spring element used is subject to variation, depending on the nature of the pivoting or other folding or yieldable mounting arrangement which allows vane 22 to yield from race 24. The invention can be applied to vanes secured to either the inner or outer race portions of the throat, or perhaps other suitable regions in the throat. The type and shape of vanes 22 which the invention is capable of yieldingly supporting is also subject to variation according to many known types of vanes in the art. Techniques for connecting the various components of a yieldable spring mount for a vane will also be subject to variation according to the skill of those experienced in the art.

Accordingly, we claim:

1. In a coal mill pulverizer throat, a damage-resistant vane assembly comprising:

a deflectable vane mounted in the throat on a spring support, the spring support being designed to support the vane in a normal position in the throat during normal operating conditions, and to allow the vane to temporarily yield to a deflected position when the vane is struck by heavy debris, and to return the vane to the normal position when the debris has passed.

2. The apparatus of claim 1, wherein the vane is mounted adjacent an inner race of the pulverizer throat to move from the normal position to the deflected position, and the spring support comprises a spring member between a lower side of the vane and the inner race, the spring member acting against the lower side of the vane to maintain the vane in the normal position during normal operating conditions and to yield the vane to the deflected position when the vane is struck with heavy debris.

3. The apparatus of claim 2, wherein the vane is pivotally mounted on the inner race and the spring member is a torsion spring.

4. The apparatus of claim 2, wherein the vane is pivotally mounted on the inner race and the spring member is a leaf spring.

5. The apparatus of claim 2, wherein the spring member is at least one tubular spring secured at an inner end to the inner race so as to extend horizontally from the race into the throat, the vane being supported on an outer portion of the tubular spring with an inner edge of the vane adjacent the inner race in the normal position.

6. The apparatus of claim 5, wherein the spring member comprises a pair of tubular springs, the vane being supported on an outer portion of the pair of tubular springs.

* * * * *